United States Patent [19]

Butement

[11] 3,941,593

[45] Mar. 2, 1976

[54] ELECTRO-PHOTOGRAPHIC METHOD AND ELEMENT

[76] Inventor: William Alan Stewart Butement, 5A Barry St., Kew, Victoria, Australia

[22] Filed: Nov. 22, 1972

[21] Appl. No.: 308,700

[30] Foreign Application Priority Data

Sept. 12, 1971 Australia ..... 7367/71
Aug. 18, 1972 Australia ..... 142/72

[52] U.S. Cl. ..... 96/1.5; 96/1 R; 96/15; 96/1 LY; 96/1.8; 427/14; 427/15; 427/19; 355/3 R

[51] Int. Cl.[2] ..... G03G 5/04; G03G 13/22

[58] Field of Search ..... 96/1 R, 15 D, 1 LY, 1.5, 96/1.8; 117/37 LE

[56] References Cited

UNITED STATES PATENTS

| | | | |
|---|---|---|---|
| 2,599,542 | 6/1952 | Carlson | 96/1.5 |
| 2,917,385 | 12/1959 | Byrne | 96/1.5 |
| 3,005,707 | 10/1961 | Kallmann et al. | 96/1.5 |
| 3,013,890 | 12/1961 | Bixby | 96/1 R X |
| 3,084,043 | 4/1963 | Gundlach | 96/1 LY |
| 3,281,857 | 10/1966 | Kaiser | 96/1 R X |
| 3,288,605 | 11/1966 | Macklem | 96/1 R |
| 3,346,475 | 10/1967 | Matkan et al. | 96/1.3 X |
| 3,409,899 | 11/1968 | Cowan et al. | 346/74 ES |
| 3,594,159 | 7/1971 | Kaufman | 96/1 R |
| 3,737,311 | 6/1973 | Wells | 96/1 R |

FOREIGN PATENTS OR APPLICATIONS

| | | | |
|---|---|---|---|
| 797,027 | 6/1958 | United Kingdom | 96/1 R |
| 873,080 | 7/1961 | United Kingdom | 96/1 LY |
| 954,052 | 4/1964 | United Kingdom | 96/1 R |

*Primary Examiner*—Roland E. Martin, Jr.
*Attorney, Agent, or Firm*—Dennison, Dennison, Meserole & Pollack

[57] ABSTRACT

An electro-photographic method and apparatus in which the photo-conductive material is on an optically transparent base, the voltage at each position on the photo-conductive material or on small areas of conductive material associated therewith being depended on the amount of light impinging on the photo-conductive layer through the transparent base and on a potential set up between an electrically conductive layer located between the base and the photo-conductive layer and on an element located on the other side of the photo-conductive layer, pigment being accepted in an amount depending on the variable voltage.

8 Claims, 11 Drawing Figures

ELECTRO-PHOTOGRAPHIC METHOD AND ELEMENT

This invention relates to improved methods of electro-photography and apparatus for use therewith.

Electro-photography currently employs either an air-suspended, or a liquid suspended developing pigment.

The older system, using the former technique, was first developed in the Battelle Institute in the U.S.A.; it makes use of a surface coated with a photo-conducting material, usually selenium. This surface is charged to a potential of some hundreds of volts, by a suitable device, and it is then exposed to an image of the material to be copied, for example, by means of an epidiascope or other lens system. Certain areas of the photo-conductive surface are thus discharged, or partially so, leaving a latent image of charged areas. This latent image is then developed by exposing the surface to an air-powder emulsion of which the powder comprises pigment particles encased in a readily fusable resin. The powder is attracted by and becomes attached to the charged areas.

The powder image is transferred, by the application of an electric field, to a sheet of paper placed in contact with the surface. The paper is heated to cause the resin to melt, and the pigment to become bound to the surface.

In an alternative form this basic technique can be used with a paper coated with a photo-conducting material, such as zinc oxide upon which the latent image is formed. As the latent image is formed directly on the paper and the pigment is applied thereto there is no necessity to transfer the image as is the case where this is initially formed on a photo-conducting material such as selenium but the technique is only useful where the photo-conducting material is a colour satisfactory for the finished product.

The second system, which is more recent and uses a liquid-suspended developing pigment, was evolved in the laboratories of the Australian Commonwealth Department of Supply, in Finsbury, South Australia. Paper is coated with zinc oxide bound with a resin, providing a photo-conductive surface which is charged to a potential of some hundreds of volts. It is discharged, in part, by an image of the material to be copied, as in the older method, but is developed in a bath of organic liquid. In this liquid are dispersed pigment particles, coated with suitable resin. The particles become charged naturally in the developing liquid, and are attracted to the latent image of charged areas of the zinc oxide surface. The paper is removed from the bath, the liquid is evaporated, and, on drying, the pigment becomes fixed to the surface.

In both of these techniques the surface must be charged, necessitating equipment for the purpose. Good prints from photographs having a full range of tonal density, cannot readily be made by the older process, as the charge on an unexposed area of the selenium tends to concentrate at the edges of the area, whereas with the later process, coated paper is necessary. Also, if the coating of the paper must be rendered panchromatic, the dyes used for the purpose tend to make it undesirably off-white.

British Pat. No. 797,027 describes a process having some features in common with my invention, to be described herein. The process does not appear to have found any industrial acceptance so it may well be that a satisfactory realisation could not be achieved.

The object of the invention herein to be described is to provide a method of making prints by electro-photography which minimizes or overcomes the disadvantages which have previously existed, which require neither charging equipment or specially coated paper and which, when applied to a printing apparatus, can operate rapidly whilst giving a true image.

A further object is to provide various forms of apparatus making use of the method of the invention, which apparatus can provide both monochrome and full colour prints.

The invention includes in or for electro-photographic apparatus an image receiving plate comprising a transparent base, a layer of optically transparent, electrically conducting material on the base and a layer of photo-conductive material on the layer of optically transparent, electrically conducting material. Specifically it is preferred that the photo-conductive surface is coated with metal and the surface of the matal is treated to form a number of discrete areas of metal each of which is surrounded by and spaced from further metal which is in the form of a mesh the said mesh being continuous. In another preferment a layer of highly resistant material is placed over the mesh, the surface is again coated with a metal which is treated to form a number of discrete areas of metal, the resistance material surrounding the areas removed as is the photo-conductive layer, except where this is protected by the mesh, the spaces being filled by an insulating material.

The apparatus of the invention includes a plate of the foregoing type and has means whereby an image can be caused to impinge on the photo-conductive layer through the base, a developing tank located over the said layer and insulated therefrom and a power source to provide a voltage between the layer of optically transparent, electrically conducting material and the developing tank or a plate thereon or associated therewith.

The method of the invention includes using a plate of transparent material having an optically transparent, electrically conducting material deposited thereon and a layer of photo-conductive material on the layer of optically transparent electrically conducting material, applying a potential across the layer of photo-conductive material illuminating the plate with an image of the material to be photographed and passing developer which includes a pigment adjacent the layer of photo-conductive material whereby pigment particles move towards the layer of photo-conductive material, the rate of pigment buildup having a relationship with the light incident on the layer of photo-conductive material there adjacent.

In a further aspect the invention includes an electro-photographic apparatus a colour correction device including a pair of light paths each of the same length, a filter in each light path one of the filters being to provide a colour separated image and the other a colour correction image.

In order that the invention may be more readily understood it shall be described with reference to the accompanying drawings in which.

Figure 1:
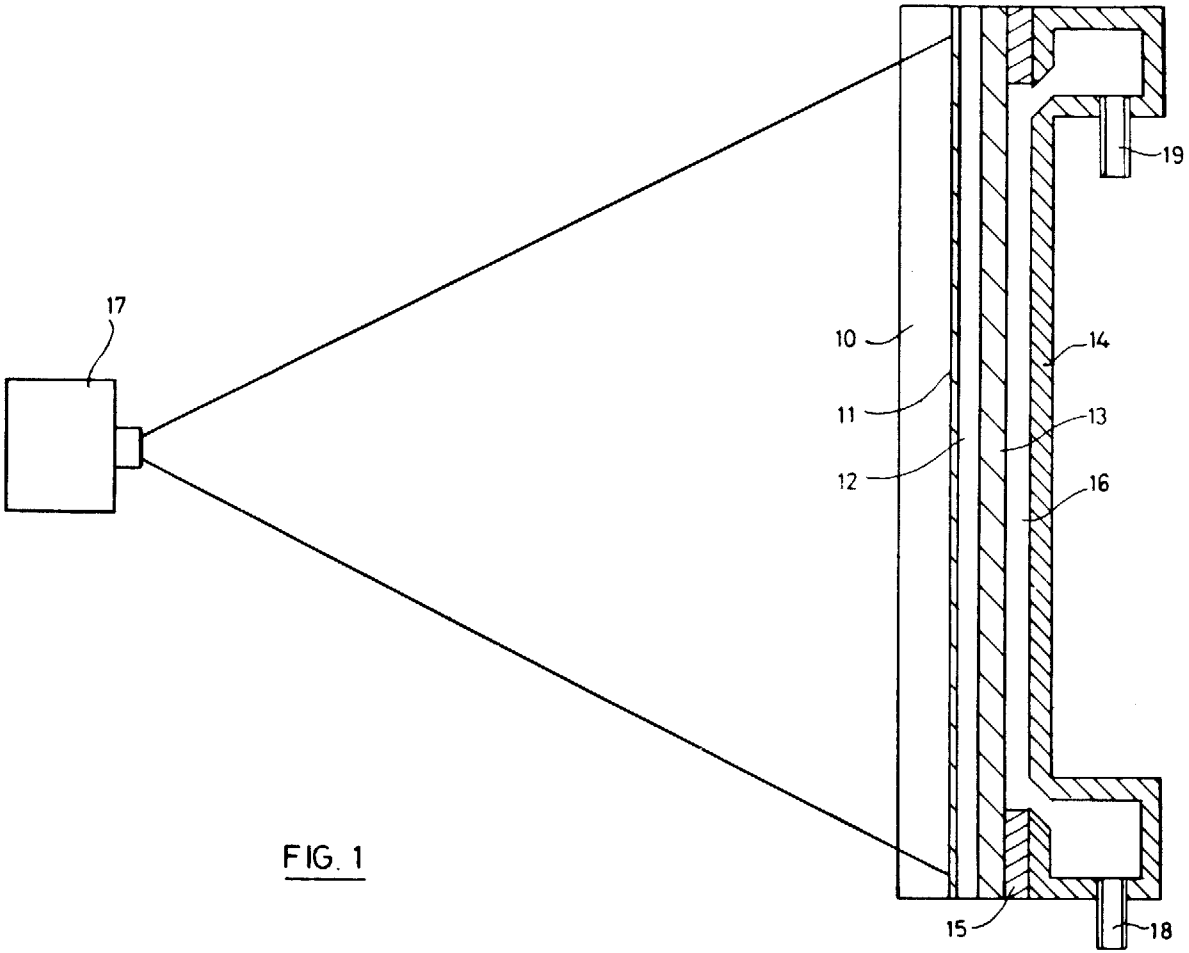
FIG. 1 is a schematic view of a basic, simple form of the apparatus.
Figure 2:
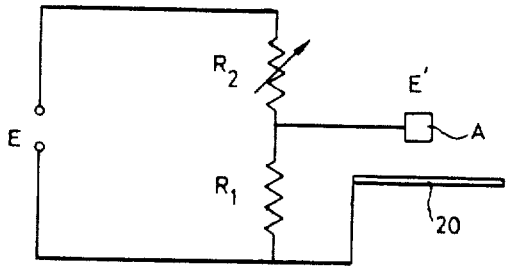
FIG. 2 is an equivalent circuit showing the effective electrical operation of a small part of the apparatus.

The embodiment of FIGS. 1 and 2 illustrate a simple version of the invention which help to illustrate the principles incorporated in the invention. Later embodiments are practically more preferred.

In the embodiment of FIG. 1, we provide a sheet of transparent material 10, which is preferably glass and this is coated with a layer 11 of an electrically conductive material which is nevertheless optically transparent. This layer 11 may be tin oxide and a technique for applying such layers has been developed by the Pittsburgh Plate Glass Company in the United States of America. Coated over the electrically conductive layer 11 is a layer 12 of a photo-conductive material which may satisfactorily but not necessarily be zinc oxide bound with a suitable resin. When the apparatus is to be used a sheet of paper 13 is butted against the photo-conductive layer 12 and the paper has its outer surface directed to a developing tank 14. A gasket 15 permits a liquid tight seal to be made between the paper 13 and the interior 16 of the tank. This gasket also ensures that the tank is electrically insulated from the sheet of paper 13.

In order to ensure a close contact of the paper sheet 13 to the photo-conductive layer 12 a conventional vacuum arrangement can be used. A projector or the like 17 is arranged to transmit an image onto the glass sheet 10, or alternatively, the arrangement may be such that a transparency can be placed in contact with the sheet and means to illuminate the transparency provided.

In either case the image impinges upon the photo-conductive layer 12. A potential is established between the electrically conducting layer 11 and the developing tank. It will be recalled that the developing tank is electrically insulated from the layer 11 by means of the gasket 15. The potential required is normally of some hundreds of volts.

A developing liquid is then passed through the tank as will be described hereinafter.

The developing liquid is suitably conductive as explained hereinafter it may be either organic or inorganic. In some circumstances water may be quite suitable. Dispersed in the developing liquid there are particles of pigment which particles include means whereby they may bound to the paper surface. In one arrangement they may have been coated with a resin or similar substance and in the developer this resin is dissolved by a suitable solvent so as to provide a viscous coating on the pigment particles. These particles are dispersed in the liquid to form a stable colloidal suspension and to assist in maintaining this suspension an emulsifying agent may be required. For example one developer which may well be satisfactory use a water base, toluol and xylol are used to dissolve the resin on the pigment and as an emulsifying agent cholesterol and sodium cetyl sulphate may be added.

This developing liquid can be passed through the tank from inlet 18 to outlet 19 and as the pigment particles are charged they will tend to contact the paper.

Preferably the developing liquid is drained whilst the light image is still being applied to the photo-conductive layer 12 and the liquid is evaporated. During evaporation the bounding resin becomes connected to the paper sheet 13 thus fixing the image on the paper.

The image is formed because of the varying resistivity of the photo-conductive layer 12 depending upon the amount of light impinging thereon. For example under dark conditions the resistivity can be of the order of $10^{17}$ ohm $cm^{-3}$ whilst under strong light conditions the resistivity can fall to $10^5$ ohm $cm^{-3}$. This is illustrated in FIG. 2. In this FIG. A respresents a small area of the surface of the photo-conductive layer in contact with the paper, light incident on the photo-conductive layer 12 will control the resistance $R_2$ between the area A and the optically transparent electrically conducting layer 11'' area A. The ohmic resistivity of the developer liquid immediately between area A and the wall 20 of the developing tank 14 can be considered to be a resistance $R_1$ which is constant. The voltage source E connected between the electrically conducting layer 11 and the developing tank 14 is connected across the resistances $R_1$ and $R_2$ which form a potential divider so that the surface area A will be maintained at a voltage $E^1$ which equals $ER_1/R_1+R_2$. The potential $E^1$ varies with the value of the resistance $R_2$ and thus in accordance with the intensity of the light falling upon the photo-conductive layer below the area A from the portion of the original to be reproduced at A.

Charged particles of pigment will thus be attracted to the area A and this attraction will be dependent upon the voltage. As the paper sheet 13 is located betweeen the pigments and the photo-conductive surface the pigment will be deposited upon the paper at a density which varies with the value of $E^1$.

It is preferred that the paper has a conductivity comparable with that of the liquid and this can be maintained at a suitable value by storing the paper in a humidifying chamber, by pre-treating it with a dilute solution of a deliquescent substance, or in other ways.

In a variation of the above described embodiment, the photo-conductive surface may be coated with metal, and this may be etched to form a mesh of metal remaining in contact with the photo-conductive surface. Suitably conductive paper may be pressed onto the mesh, and the whole may be offered up to the developing liquid in the manner already described. In this case the conductivity of the liquid is not important; the resistance R, is provided by the resistivity of the paper between the photo-conductive surface and the mesh.

In an alternative form of operation of the method illustrated by FIG. 1, it is possible to first deposit the image directly onto the surface of the photoconductive layer and subsequently transfer the pigment to paper.

For example the image may be formed, a sheet of paper pressed evenly upon the pigment coated surface for example by a sheet of sponge rubber or plastic material fixed to a flat surface with a sheet of a fine metal mesh located between the sponge and the paper. Developing liquid can be passed into the chamber 14 which liquid of course does not have to contain pigment particles and a potential difference is applied between the metal mesh and the electrically conducting layer 11 which potential is of such a polarity that it will attract the particles towards the metal mesh thus the particles migrate from the photo-conductive layer to the paper. The developer tank 14 is then drained, the developer permitted to evaporate and the image is fixed to the paper surface.

Although the form of use of the method described above and illustrated in FIGS. 1 and 2 can provide a satisfactory image it must be appreciated that such an unsophisticated arrangement can have difficulties. Specifically there will tend to be a certain amount of migration of pigment to areas of the paper which should be white. Thus there can be an overall slightly grey toning to the paper.

Figure 3:
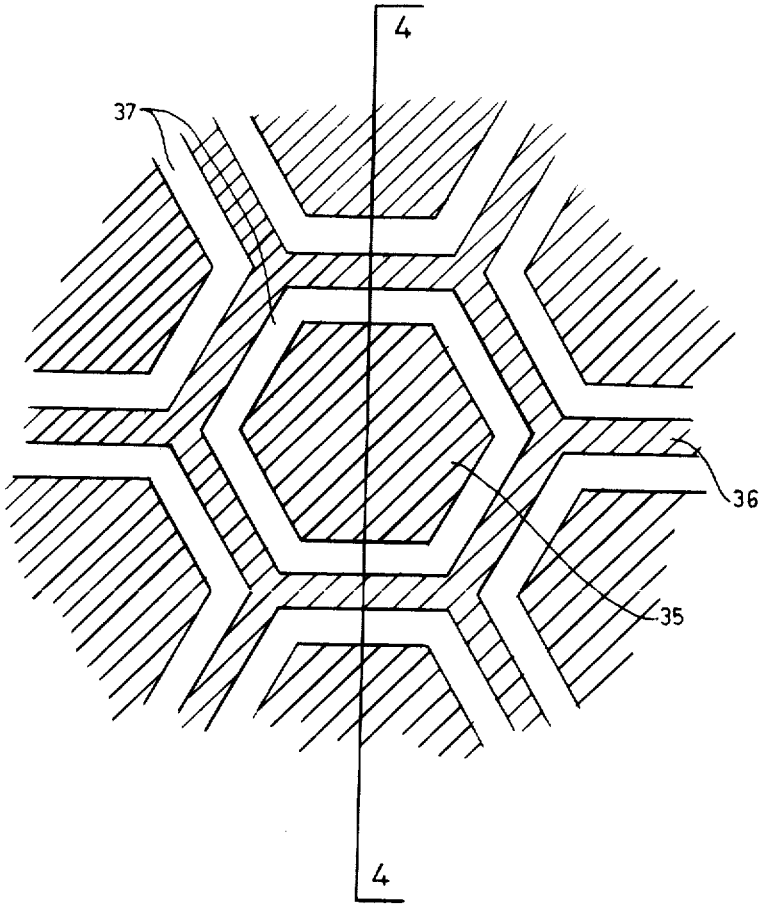
FIG. 3 is a plan view of one surface of a preferred form of image accepting plate which may be used in accordance with the method of the invention.
Figure 4:
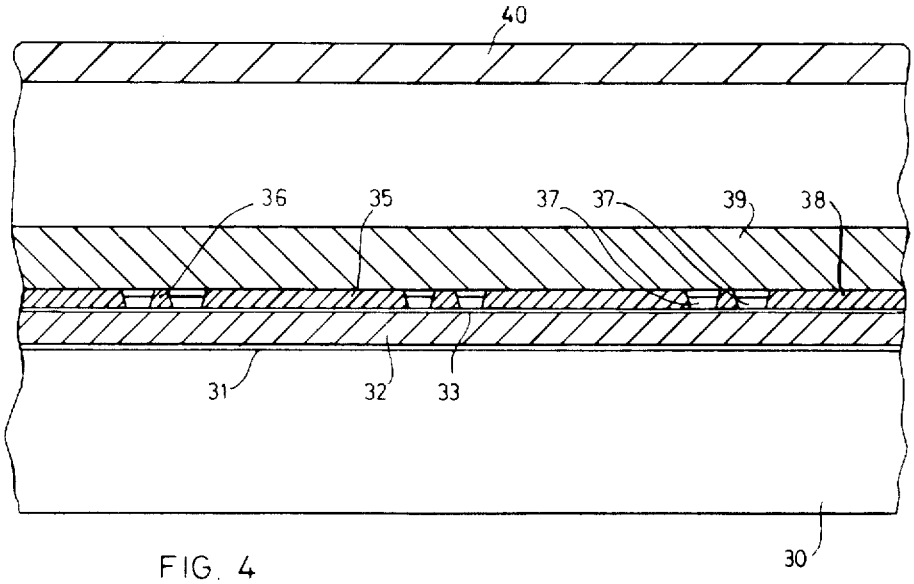
FIG. 4 is a cross section along line 4—4 of FIG. 3 and showing a sheet of paper and the developing tank in position.
Figure 5:
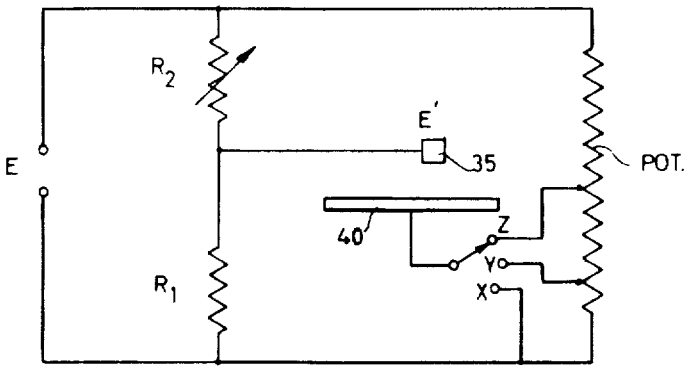
FIG. 5 is an equivalent electrical circuit showing the operation of the form of the invention using the arrangement of FIG. 3 and FIG. 4.

These difficulties can be overcome by use of an arrangement such as illustrated in FIGS. 3 to 5. Referring to FIG. 4 a sheet 30 of a transparent material such as glass is coated with a layer 31 of optically transparent electrically conductive material, the layer being equivalent to layer 11 of the earlier embodiment. A layer 32 of a photo-conductive material is coated over the layer 31 and this layer is equivalent to layer 12 of the earlier embodiment. Over the layer 32 there is deposited a layer 33 of a resistive material which can, for example, be nickel vacuum deposited over the layer 32. Over this resistive layer 33 there is provided a layer of photo-resist material. A suitable photo-resist material is that sold by the designation K.P.R. by Kodak (Australasia) Pty. Limited. This photo-resist material is exposed through a photographic negative of a pattern of small discrete area which are interspersed with a continuous mesh as illustrated in FIGS. 3 and 4. The discrete areas are shown as being hexagonal but any other pattern which provides discrete areas surrounded by a continuous arrangement could equally satisfactorily be used.

The unexposed photo-resist material is removed from the areas 35 and 36 whilst the remainder, which has been rendered insoluble by light remains in the areas 37.

A layer 38 of conducting material, preferably cooper or silver is then electro-plated or otherwise deposited onto the exposed surface producing a series of areas 35 of electrically conductive material resistively connected by means of portions of the layer of electrically resistive material 33 to what is effectively a conducting mesh 36 of the conducting material deposited on the surface. Using this form of the invention a layer of paper 39 is held in intimate contact with this outer conducting layer and a developing tank 40 can be located thereagainst in a manner similar to that described in relation to the first embodiment. In this form of the invention the resistivity of the developer is not critical as was the case in earlier embodiments. The resistance $R_1$ is not provided by the developing liquid but by the resistive material of the layer 33 which is embodied within the printing screen. Thus the areas 35 are held at a voltage $E^1$ which is dependent upon the light intensity of the corresponding portion of the image and will attract more or less charged particles from the developer depending on whether $E^1$ is a high or low voltage.

Because the developer liquid does not provide the resistance $R_1$ its resistivity may be substantially higher than in the first form and may depend predominantly upon the charges conveyed by the movement of the charged pigment particles. Thus the speed of development will be much greater in this embodiment than was the case in the earlier embodiment. A schematic equivalent electrical arrangement is shown in FIG. 5 and in this the area 35 is effectively one of these areas in the screen. As in FIG. 2 the developer tank or a plate therein is shown as 40. The arrangement is such that the tank, or the plate therein can be held at any predetermined potential.

In order to do this we provide a potentiometer POT which is connected across the voltage source E and as illustrated there are three taps associated with the potentiometer X, Y, and Z. If the developing tank 40 is connected to tap X the situation will be as described in relation to the first embodiment and a negative transparency will produce a positive image.

Even assuming the area 35 is in darkness and thus the area of photo-conducting layer 32 associated therewith has its highest resistivity and thus the voltage $E^1$ is low some pigment can be deposited upon the surface and thus the difficulty mentioned with the earlier embodiment, that is an overall grey background may still obtain. In fact even if voltage $E^1$ is zero there can, because of the general movement of the pigment particles be certain of these which contact the paper associated with area 35. Thus it is desirable to impart a small voltage to the plate 40 which sets up a field which causes the pigment particles to be repelled by the area 35 if white areas in the original are to be truly reproduced. This situation can be obtained simply by connecting the plate to the tap Y on the potentiometer POT to thereby give the desired potential.

The third tap Z is provided so that the voltage on the tank or plate 40 is slightly greater than that on the area 35, when the light on the portion of the photo-conductive layer 32 associated with the area 35 is at its maximum. Under this condition a positive print can be made from a positive original or transparency.

Thus by simple control of the voltage on plate or developing tank 40 by means of the taps X, Y and Z on the potentiometer and reversal of the polarity of the voltage E the form of device can provide a positive or negative print from either a negative or positive transparency or other original and can ensure that a positive print from a negative original has a full range of tonal gradations from black to white.

By modification of this particular embodiment it is possible to obtain black and white prints more rapidly than has previously been practicable by any other known method of reproduction whilst, at the same time, the equipment necessary is cheaper and simpler than previously proposed forms.

The embodiment of FIGS. 3 to 5 may not be completely satisfactory where a positive print is being made from a positive original, that is when the potentiometer tapping Z is connected to plate 40 and an image developed upon the plate is to be transferred to paper as there can be a certain deposit of developer on the mesh 36 of FIG. 3. This will occur because when no light from the original falls upon the photo-conductive surface the resistance $R_2$ of FIG. 5 will have an extremely high value and thus the area 35 will be at zero potential whilst the developing tank or plate 40 will be at some finite voltage depending on the position of the tap of Z. If then this is a positive potential and positively charged particles are used in the developer then the mesh will attract developer and the print will thus be imperfect.

Figure 6:
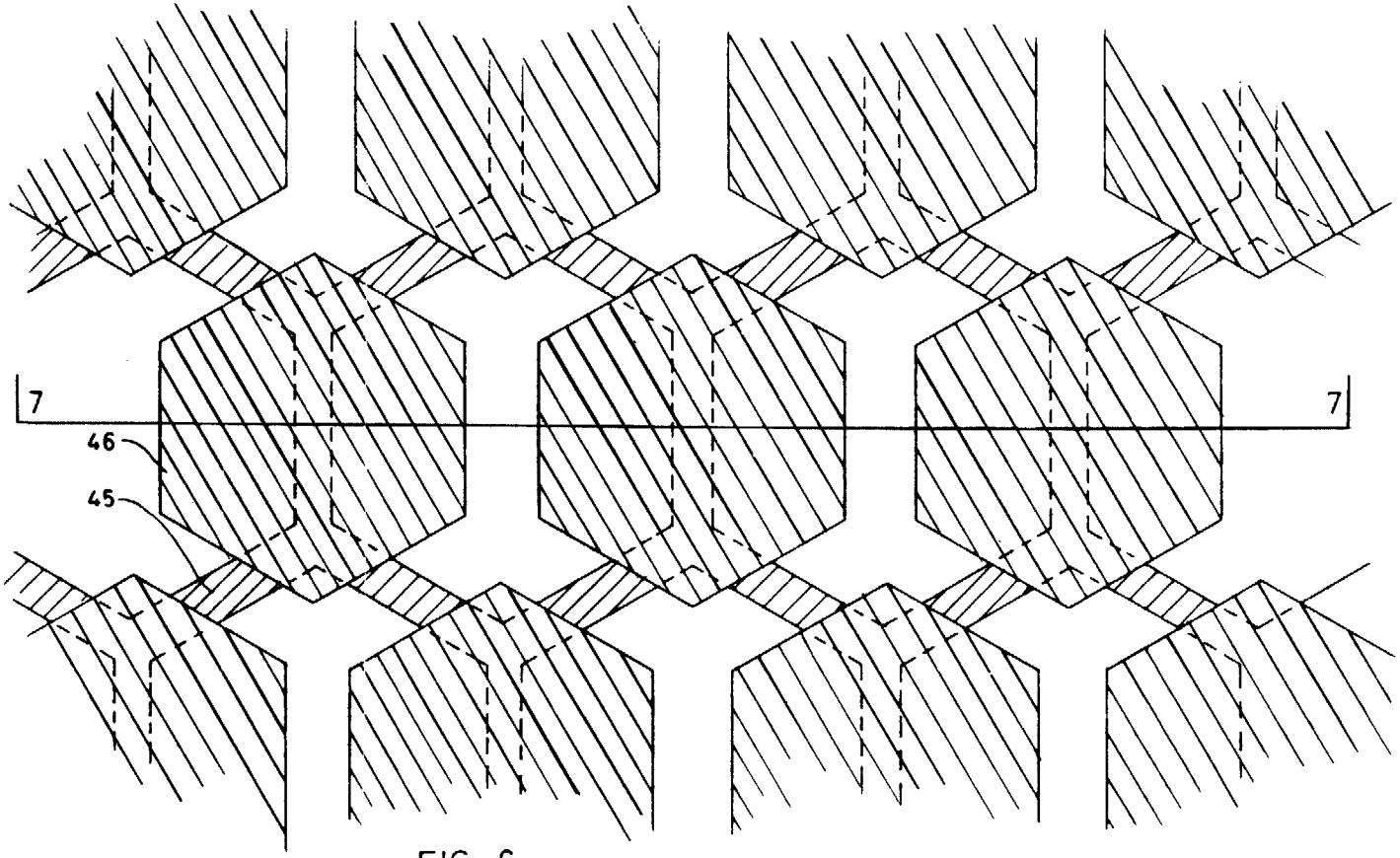
FIG. 6 is a plan view of an alternative form of plate to that illustrated in FIGS. 3 and 4.
Figure 7:
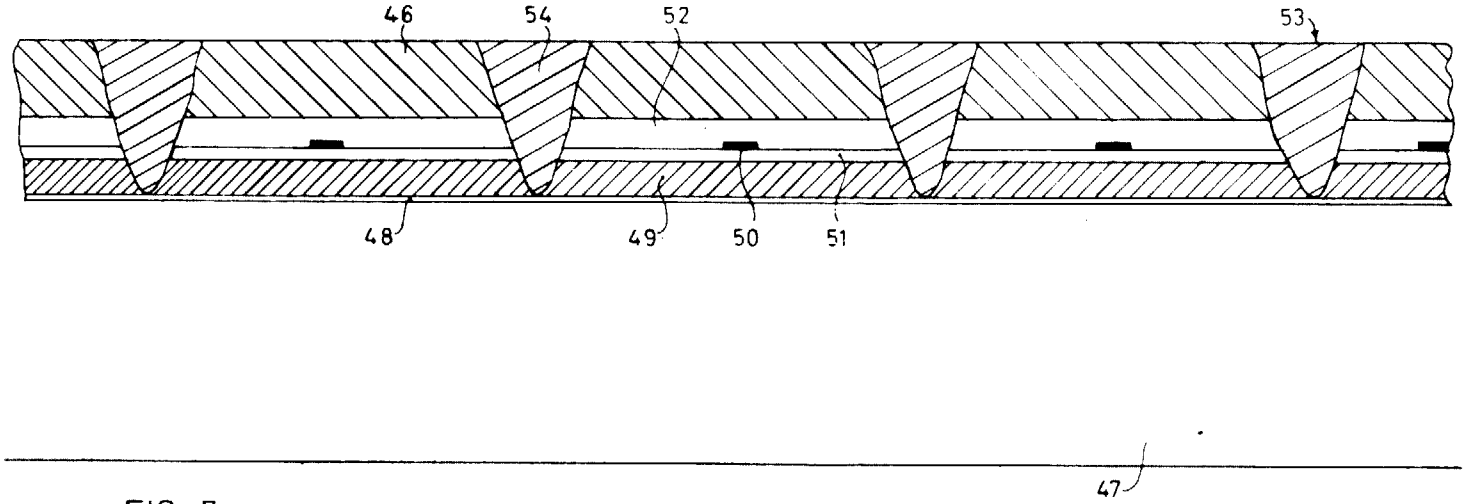
FIG. 7 is a cross sectional view of the plate of FIG. 6 along the line 7—7 of FIG. 6.
Figure 8:
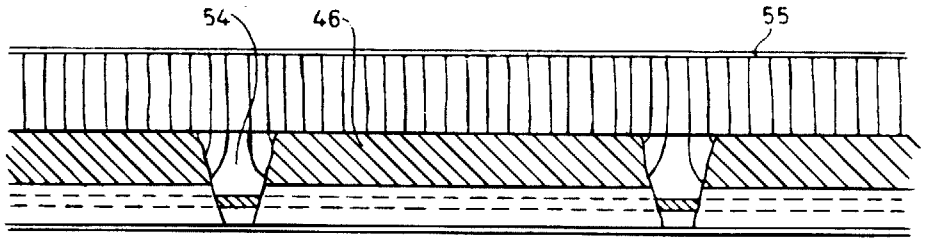
FIG. 8 shows the lines of force set up on the arrangement of FIG. 7.

In the embodiment of FIGS. 6 to 8 this difficulty is overcome by locating the mesh 45 below the surface of the plate so that it is only the areas 46 which can attract developer pigment. In this embodiment I again provide a sheet of glass or other transparent material 47 upon which there is a layer 48 optically transparent and electrically conductive material such as tin oxide. This layer is similar to the equivalent layers in the previous embodiments. The layer 49 is a layer of photo-conductive material which may be zinc oxide or which may be a material such as cadmium sulphide doped with magnesium and oxygen. In either case the material would be bound with a suitable resin. This layer may be deposited electrophorectically as has been described in the art or may be sprayed on the surface as a solution or may be applied in other ways. As the colour of this layer has no bearing upon the end print it is of course not essential that it should be white and for this reason it may be desirable to use a material such as cadmium sulphide which can provide a printing rate which is faster than by using zinc oxide. Positioned over the layer 49 is a layer of metal 50 which can be copper or silver. Copper may be deposited by a process developed by the Shipley Company of the United States of America in which the copper is desposited from an alkaline solution. If it is necessary to protect the surface of the layer 49 it is possible to provide an intermediate layer 51. This layer may consist of a high resistivity plastic which is mixed with a conductive material such as carbon black. Alternatively it may consist of a layer of a plastic material which itself has a suitable resistivity, as will be hereinafter. The surface of the copper or other metal or other conductor is now coated with a layer of a photo-resist material such as that produced by the Shipley Company under the reference AZ 111. After this layer has been dried it is exposed to light so that a mesh shown as 45 in FIG. 6 is protected from the light whilst the remainder of the surface is strongly irradiated. The irradiated areas are then washed clear of the photo-resist material in an alkaline solution and the copper exposed is etched away using a conventional etching solution. Thus there is left a mesh 45 which is shown as 50 in FIG. 7. A layer 52, which is preferably of the same material as layer 51, if layer 51 is used, is then applied over the whole surface of the sheet. The surface of this layer 52 is then coated with copper, another metal or other form of conductor as was the surface of layer 51, again a photo-resist material such as AZ 111 is coated thereover, dried and exposed to form the areas 46 of FIG. 6. Again the photo-resist material in the exposed areas is washed away and the copper is etched so that the islands are formed and are isolated one from another. The surface of the layer 52 is then washed, where cleared of copper by jets of a suitable solvent so that these areas are dissolved away. Similarly the layer 51 is also dissolved away in these areas if there is such a layer and the same or a different material is used to wash away the equivalent portion of the photoconductive layer 49, this being demonstrated at 53. The areas 46 are thus isolated one from the other down to the layer 48 except of course where the mesh 45 is located as this mesh prevents material therebelow being washed away. The spaces so formed can then be filled with an insulating material 54 which material may be an epoxy resin and the surface of the plate can be gently polished.

The mesh 45 is resistively connected to the areas 46 by the remaining portions of the layer 52 whilst other parts of the areas 46 are resistively connected to the electrically conducting layer 48, when the layer 49 is illuminated (by way of the layer 51 is used) and the photo-conductive material 49, the interconnection between the mesh 45 and the areas 46 provides the resistance $R_1$ of FIG. 5. Whilst the interconnection between the areas 46 and the electrically conducting surface 48 forms resistance $R_2$. It will be appreciated that the resistive layer 52 not only provides resistance $R_1$ but also provides a theoretically undesirable resistance between the area 46 and the photo-conductive surface 49. If there is a layer 51 this adds to this undesirable resistance. It can however be shown that this additional resistance is normally small in comparison with $R_2$ whilst the layer 52 provides a satisfactory value of $R_1$. Even if the undesirable resistance, equals $R_1$ and $R_1$ equals $R_2$, and if the applied potential is 500 volts than the voltage $E^1$ applied to an area where its base is fully illuminated will be 166 volts which is a suitable and adequate value for fast development.

A maximum value of $R_2$ less than that of $R_1$ may be desirable if a linear relationship between the voltage applied to an area and the light illuminating the associated part of the photo-conductive layer 49 leading to a lesser value of $E^1$. Under these circumstances fast development can still be achieved. FIG. 8 shows the general lines of force in respect of the plate of FIGS. 6 and 7 when associated with either portion of a developing chamber or a plate 55. It will be seen that all lines between the printing plate and the plate 55 terminate on the areas 46 the mesh 45 being screened by these areas.

It will be seen that the manufacture of the plate is relatively simple using techniques which are well established in the manufacture of electronic integrated circuits. In operation the plate of the embodiment of FIGS. 6 and 8 is identical to that of the previous embodiments.

If desired the paper may be placed against the outer surface of the plate and the pigment attracted thereto or, alternatively, the pigment can be applied to the plate and either removed therefrom by placing paper thereagainst and changing the field or simply by a physical process of pressing the pigmented plate against a sheet of paper as would occur in a normal printing process.

The method of the invention has certain features which are advantageous and which are not all possessed by previously proposed methods of electrophotographic reproduction. These are:

a. The speed of reproduction can be faster than previous forms as the fastest available photo-conductors can be used regardless of their colour and because each area 46 is maintained at constant potential during developer pick-up; using charged photo-conductive surfaces, the potential falls during developer pick-up.

b. Ordinary paper can be used; special coatings involving exacting techniques in preparation, as used in most current liquid developer systems, are not required.

c. No charging device, or source of high voltage equipment is required, consequently simpler apparatus can be designed.

d. Using electro-photographic printing plates, such as have been described above, it is possible to produce a positive print from a positive, or from a negative original, merely by reversing a switch, the switch also being designed so as to reverse the polarity of the supply voltage. The developer need not be changed when changing from a negative to a positive original as with existing systems.

e. Black and white photographs alone, or in conjunction with written material, may be faithfully reproduced, with a full range of semitones. Although the area of the areas 46 does not equate to the whole area of printing surface (the resin 54 in the spaces between the areas 46 occupying some of the area) nevertheless, where full black is to be reproduced, an amount of developer is taken up, such that when the plate is pressed onto paper, and the developer is transferred thereto, the developer is forced sideways to an extent just sufficient to bridge the gap between the print from one area 46 and the next. The method of the invention can also be used for colour reproduction work. In the simplest way the original can be exposed through a red filter and a Cyan pigment is used for transmission to the paper or the surface of the plate, the paper to which the image is transferred either directly or via the plate is dried, the original is again exposed through a green filter and a developer using a Magenta pigment is used, the paper is dried, a further exposure is made using a blue filter and a yellow pigment is used. Such an arrangement can be satisfactory in the simpler form of device but it is well known that if such an arrangement is used the colours are not necessarily correct. The difficulty is that Cyan pigments do not absorb only red light as it also acts as though it contains a smaller amount of Magenta. This is it absorbs not only red but also some green. Likewise Magenta pigments act as though they contain some yellow. Yellow ink generally is regarded as not requiring correction as it absorbs blue and only a small trace of green. In order to overcome these difficulties it is recognized as desirable to reduce the Magenta print in those areas where Cyan ink is also printing and to reduce the yellow in those areas where Magenta is also printing. (This concept is discussed in "Basic Colour for the Graphic Arts", Graphic Arts Data Book Q-7, Eastman Kodak Company).

Figure 9:
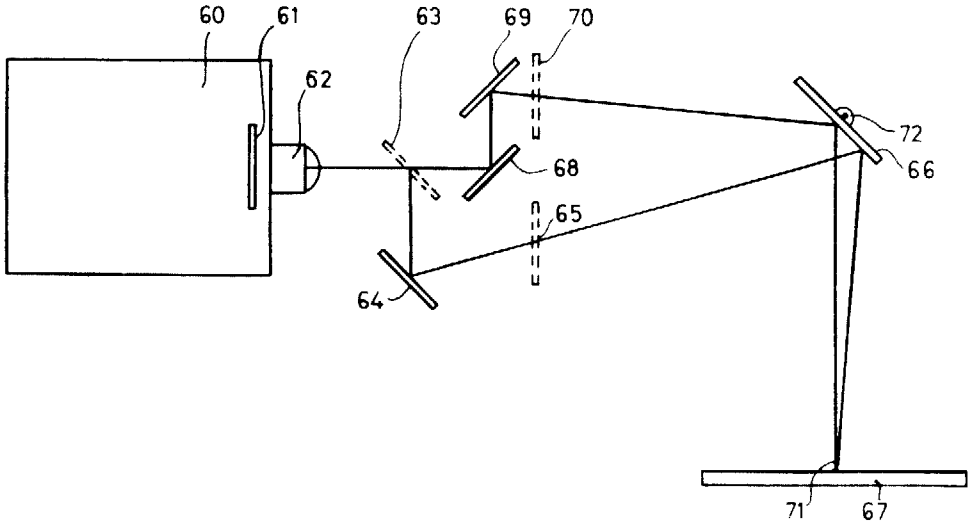
FIG. 9 shows a form of colour correction apparatus which can be used with the invention.

I have developed, and have illustrated in FIG. 9 a particular arrangement in which such correction can be made in the application of my invention. I provide a projector or the like 60 in which there is a colour negative 61. The light is transmitted through this and through a lens system 62 to a part-silvered mirror 63. The light reflected by the part-silvered mirror passes to a mirror 64, through a filter 65 to a mirror 66 and thus to the plate 67. The light which is not reflected by the part-silvered mirror 63 passes to mirrors 68 and 69 through filter 70 to the mirror 66 and to the plate 67. The two paths are made to be of equal length so that the two images are exactly superimposed at 71. In order to transmit the whole of the material of the negative onto the plate 67, the plate 67 is caused to move in a horizontal plane, say from left to right whilst the mirror 66 is caused to rotate about an axis 72. In this way an undistorted image of the negative is produced upon the plate 67. Alternatively, the mirror 66 can remain stationary and the negative 61 can be moved in synchronism with the plate 67. When the Magenta image is to be formed a green filter is used as filter 70 whilst a red filter is used as filter 65. Less light is transmitted through filter 65 than filter 70 so the beam passing through filter 70 is that which provides the main illumination on the plate 67. The amount of light passing through filter 65 is arranged to be sufficient to reduce the potential of the areas 46 where Magenta is to be printed and where Cyan is also printing.

By proper adjustment of the relative intensity of the light passing along each of the paths the error in the Cyan pigment is corrected. In a similar manner areas in Magenta pigment may be corrected by using a green filter at 65 when forming the yellow image with a blue filter at 70 and adjusting the light intensity transmitted by the two paths. After the three colours have been printed it may be desirable, as is conventional, to overprint with a black image.

Figure 10:
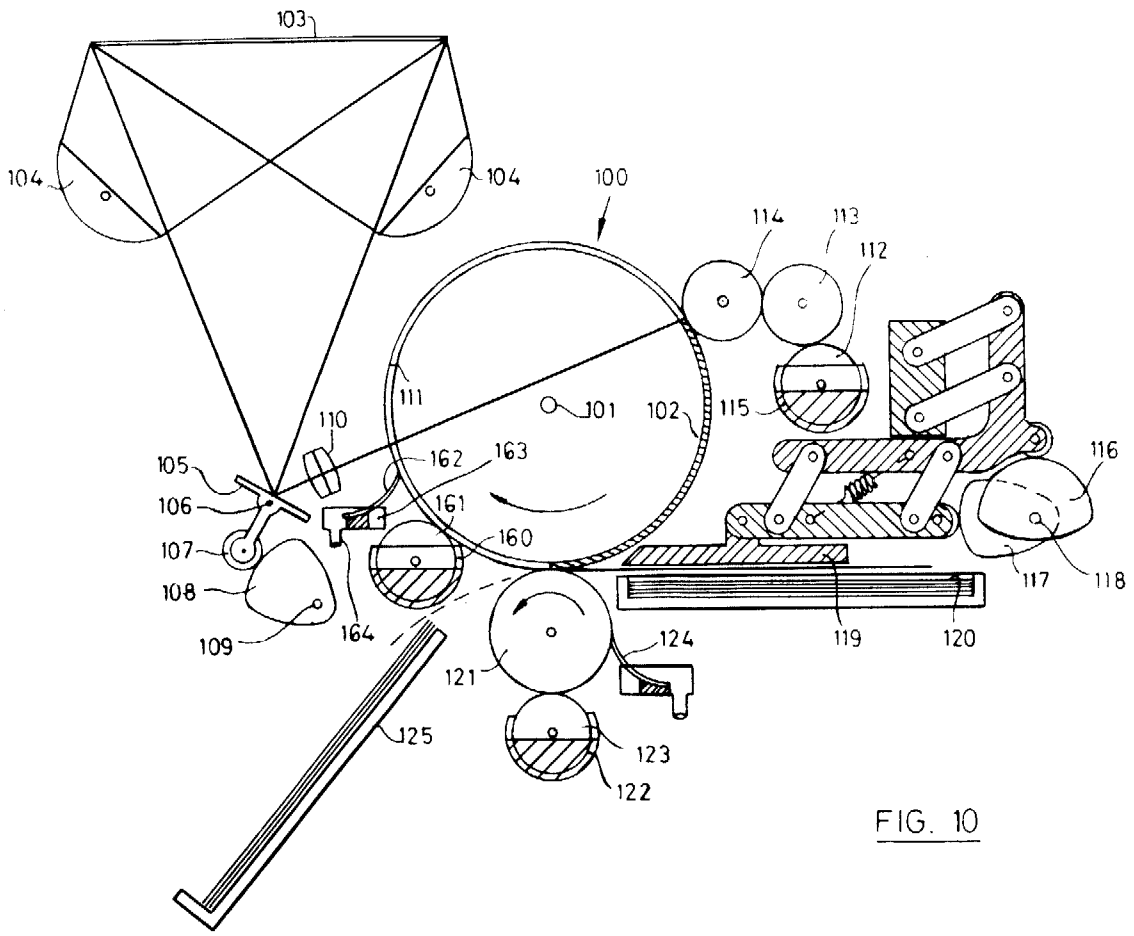
FIG. 10 shows a first form of apparatus for use with the invention when it is desired to produce monochrome prints.
Figure 11:
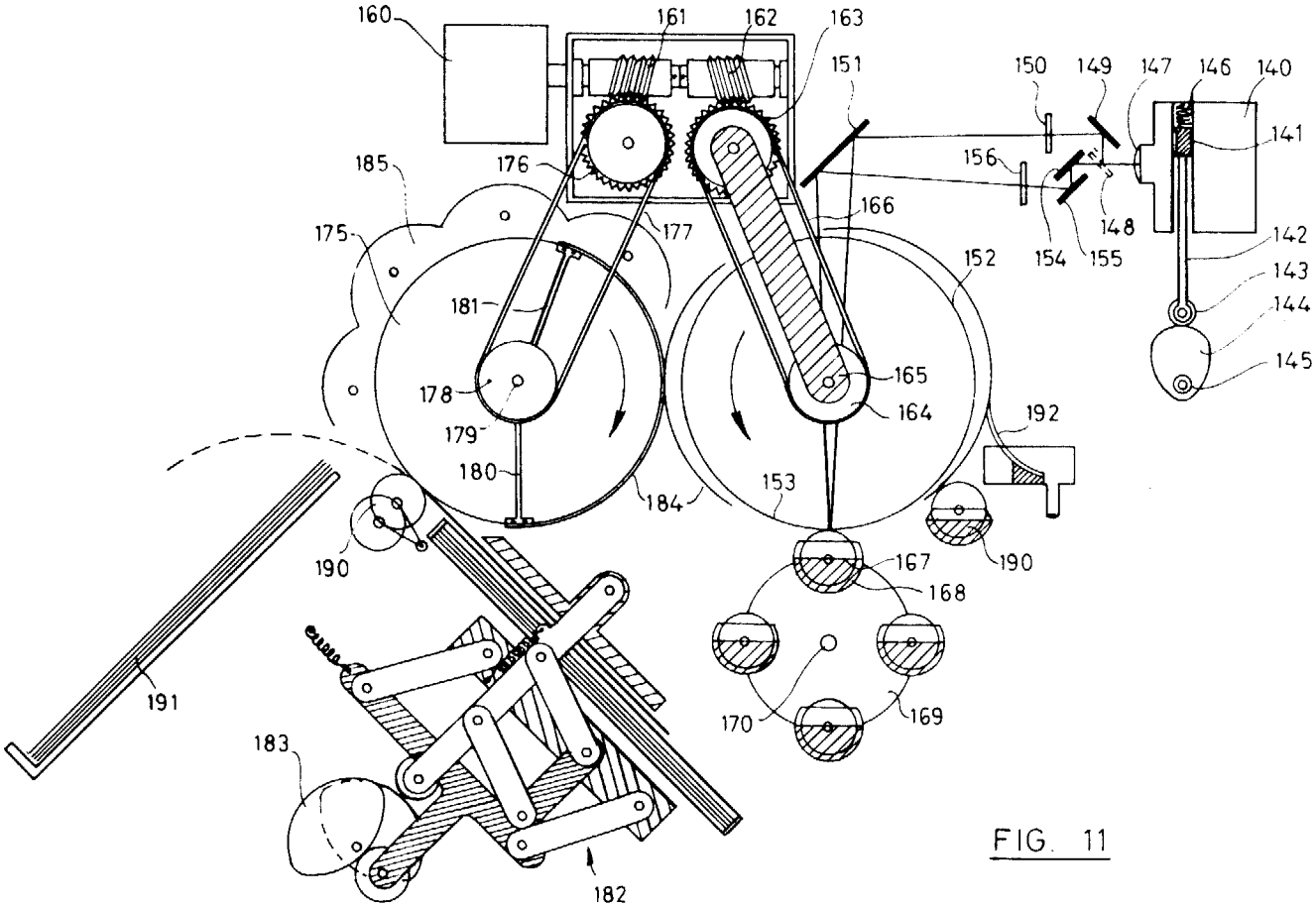
FIG. 11 is a second form of apparatus where it is desired to produce multi-coloured prints.

FIGS. 10 and 11 show two practical embodiments of my invention the embodiment of FIG. 10 being for single colour use and that of FIG. 11 being for multicolour use.

Referring firstly to the embodiment of FIG. 10 the machine is built around a drum 100 which is adapted for rotation about a pivot 101.

This drum is preferably made of glass or other transparent material and a plate 102 is formed round portion of the periphery thereof. This plate is preferably formed as described in the embodiment of FIGS. 6 to 8. The original to be copied 103 can be placed on a flat surface, which may be a glass screen or the like and it is illuminated by a pair of flood lamps or the like 104 preferably mounted at 45° to the surface so that reflection is minimized. The image impinges upon a mirror 105 which is mounted for rotation about a pivot 106 and has a bearing 107 or the like which bears against a cam 108 which is mounted for rotation about a pivot point 109.

Associated with the mirror 105 there is a lens system 110. The image from the original 103 reflects from the mirror 105 through the lens 110 through the glass 111 of the drum to the rear surface of the plate 102.

The operation of the cam 109 is so timed relative to the rotation of the drum 100 that the original is scanned and the scanned image is transmitted to the plate 102 as the drum rotates.

A developer bath 112 is provided with a first roller 113 which in turn is in contact with a second roller 114. The colloidal suspension of pigment is drawn up from the reservoir 115 and passed to the roller 114. This roller may be arranged so as to be brought into contact with the drum when the point B is located therebeside and to be removed from contact when the drum reaches point A.

This can thus be seen that as the mirror 105 commences scanning the pigment from the developer is placed on the areas 46 in an amount which depends upon the light incident on the photo-conductive layer 49 associated with the particular area 46. Once the pigment is located it is of course not necessary that the photo-conductive layer should be illuminated.

A second composite cam 116, 117 rotates about a pivot 118 and these cams are in association with a paper feed device 119 which is preferably a vacuum feed.

The movement of this device is to come into alignment with paper 120 in a supply stack, lift this paper and take it forward to a nip between the drum 102 and a roller 121. This roller may have associated therewith a reservoir 122 for a fluid which is carried by a roller 123. This fluid is spread onto the roller 121 and wiped off by a squee'gee or the like 124, thus cleaning the roller 121 if it should become contaminated by developer.

If required the roller 121 can be formed with a metallic core so that a potential can be provided on the side of the paper away from the drum 100 so that the pigment on the drum can be transferred to the paper.

The developer may include means whereby the coating of the pigment can be softened so that a permanent bond is made with the paper.

After passing between the roller 100 and the roller 121 the paper is delivered to a tray 125.

It may be desirable to clean the drum 110 after the image has been transferred to the paper and in order to do this I provide a reservoir 160 in which there is a roller 161. The liquid in the reservoir is passed by the roller to the drum either continuously or only in the plate area between B and A in the drawing and to ensure that the drum is completely dry I provide a squee'gee device 162 in association with a compartment 163 so that excess liquid is removed from the drum and passes to waste through outlet 164.

Turning now to the embodiment of FIG. 11 I provide a projector 140 which is adapted to receive a negative transparency 141. The transparency is moved by a rod 142 which has on its lower end a bearing 143 on which is mounted a wheel which is acted on by a cam 144 which rotates about an axis 145. A spring 146 is compressed by the slide as it moves upwardly so that the slide holder is held against the cam 144 as to rotates from the position shown. A lens system 147 transmits the image from a particular portion of the slide through a half silvered mirror 148 from which there is reflection to a mirror 149 through a filter 150 to a mirror 151. From this mirror the light is passed through the glass portion of a drum 152 onto the back of a plate 153 which is the same as that described with reference to FIGS. 6 to 8.

Portion of the light passes through the half silvered morror 148 to a system consisting of two mirrors 154, 155 and through a filter 156. This ray again passes to the mirror 151 and to the plate 153.

The drum 152 is rotated through a gear box 160 which has a pair of worm gears 161, 162 and worm 163 drives worm wheel 163 which is in driving connection with the shaft 164 of the drum which rotates about pivot 165. As illustrated the drive is by means of a chain 166 but any other suitable form of drive such as a keyed belt may be used. The drive must preserve registration of the images between drum 152 and drum 175. Drum 152 can move between three positions. One position, that illustrated in FIG. 11 is where the image is being projected onto the back of the plate 153 and where pigment is being supplied thereto by means of roller 167 from reservoir 168 which is one of a plurality of reservoirs mounted upon a plate 169 which itself is rotatable about a pivot 170. In this condition the image of the slide is built up on the photo-conductive surface and the particular pigment concerned can settle on the plate. It will be appreciated that the optical system is similar to that of FIG. 9 and depending on the colour concerned so correction is obtained by the light passing through to paths. When the required colour build-up is achieved either after one or more revolutions of the drum 152 the drum is moved to the dashed position where it comes into contact with a further drum 175. This drum is driven by worm wheel 176 through chain 177 to a sprocket 178 and rotates about an axis 179. The drum has paper pickup means 180 and retaining means 181 whereby a sheet of paper 184 which is delivered by means 182 can be picked up and carried about the drum. Located adjacent to the drum there are driers 185 which may be radiant or other elements.

In operation a slide 141 is located in position and is moved across the lens system 147 by the cam 144 and the projected light therefrom passes through the two filters 150, 156 which depend on the colour being produced, through the two light paths which are of equal length and to the back of the plate 153. The particular pigment concerned is delivered to the other side of the plate by the roller 167 from the reservoir 168. At the same time paper is selected by the paper delivery means 182, which may be a vacuum operated means, is delivered between the roller 175 and movable guide 190 it is accepted by the paper pick-up means 180 and the trailing edge is gathered by the means 181. In the simplest case as the image is placed onto the plate 153 the roller 152 is moved towards and into contact with the roller 175 and the particular colour image is transferred to the paper. If required an electrical field is provided to ensure complete transfer. As soon as the image has been transferred the roller 152 moves away from the other roller. This roller can move into contact with roller 190 which has a reservoir 191 and a squee'gee 192 whereby the plate can be cleaned. Whilst the roller 152 is in contact with the roller 190 the carrier plate 169 which carries the colour pigments can rotate so the next reservoir is in location for contact with the roller 152 and at the same time the filters 150 and 156 can be changed. On the next revolution the slide 141 again moves across the lens system and with different filters the image for the next colour is projected upon the plate 153 and the pigment is applied to the roller. At the end of this rotation once again the roller 152 is moved into contact with the roller 175 and the next colour is transmitted to the paper 184. This process is repeated for the third of the colour rolls and for a black overprint at which time the paper 184 has had three colours and one black impression thereon. On the completion of the revolution the leading edge of the paper is released by the holding means 180 roller 190 is brought into contact therewith and the paper is delivered to a tray 191. This is the completion of the cycle which has produced a full colour image.

If necessary a slide or image changing means can be provided so that the slide 141 is automatically replaced by the next slide and the process is repeated. It can be seen that providing the photo-conductive material can accept an image quickly it is only necessary that the drums rotate 12 times to provide a finished and fixed full colour print from an original.

In practice it may well be preferred that a larger number of rotations be used. As there is full registration between the two drums it is quite possible to permit the drum 152 to make several revolutions whilst pigment is being built-up on the plate 153 and to make one or more revolutions while this pigment is being transferred to the drum 175.

The surface drum 175 may preferably be of a conductive rubber so that good contact is made between the two drums when printing is being effected.

The roller 167 by means of which pigment is transferred to the plate 153 may be arranged to move or oscillated in the direction of their longitudinal axis. Such movement which is known in the printing art may ensure better distribution of pigment than is the case if the roller is stationary in its longitudinal direction.

It is appreciated that I have described several embodiments of the method of the invention an apparatus for carrying it out but many variations can be made in the various functions.

I claim:

1. In or for electro-photographic apparatus an image receiving plate comprising a transparent base, a layer of optically transparent, electrically conducting material on the base and a layer of photo-conductive material on the layer of optically transparent, electrically conducting material, the photo-conductive layer being coated with metal and the surface of the metal being treated to form a number of discrete areas of metal each of which is surrounded by and spaced from further metal which is in the form of a mesh the said mesh being continuous.

2. A plate as claimed in claim 1 wherein each discrete area is of hexagonal form.

3. A method of electrophotographically forming a printable image using an image receiving plate comprising a transparent base, a layer of optically transparent electrically conducting material on said base, a photoconductive layer on said optically transparent electrically conducting layer, a multiplicity of electrically conducting discrete elements arranged in a regular array on the surface of said photoconductive layer, a continuous electrically conducting mesh surrounding and spaced from said discrete elements, and an electrically resistive layer connecting said discrete elements and said conducting mesh; and an electrostatic developer fluid carrying a printing medium therein; said method comprising the steps of:

applying a voltage to said plate whereby said electrically resistive layer and said photo-conductive layer form a voltage divider with said discrete elements connected at junction points of said electrically resistive layer and said photoconductive layer:

illuminating said plate with an image to induce a voltage pattern on said discrete elements in image relation;

passing said electrostatic developer fluid between the plate surface and an opposing electrode; and applying a voltage between said image receiving plate and said opposing electrode to generate an electric field in said fluid, whereby printing medium is attracted from said developer fluid to said array of discrete elements at a rate dependent upon the voltage pattern on said array to form a printable image.

4. The method of claim 3, wherein said printing medium is collected on said array of discrete elements to form a printable image on the face of said plate.

5. The method of claim 4, further comprising the steps of interposing a sheet of printing paper between said plate and said developer fluid and in contact with the surface of said plate and said conducting mesh, said paper having electrical resistivity such that it defines said fixed resistive layer.

6. A method of electrophotographically forming a printable image using an image receiving plate comprising a transparent base, a layer of optically transparent electrically conducting material on said base, a photoconductive layer on said optically transparent electrically conducting layer, a multiplicity of electrically conducting discrete elements arranged in a regular array on the surface of said photoconductive layer, said elements defining part of the surface of said plate, a conducting mesh in said plate disposed below the surface thereof, and between said photoconductive layer and said discrete elements, and an electrically resistive layer connecting said discrete elements and said conducting mesh; and a developer fluid carrying a printing medium therein; comprising the steps of:

applying a voltage to said plate whereby said electrically resistive layer and said photoconductive layer form a voltage divider with said discrete elements connected at the junction points of said electrically resistive layer and said photoconductive layer;

illuminating said plate with an image to induce a voltage pattern on said discrete elements in image relation;

the passing said developer fluid between said plate surface and an opposing electrode; and applying a voltage between said plate surface and said opposing electrode to generate an electric field in said fluid, whereby printing medium is collected from said developer fluid and attracted towards said array of discrete elements at a rate dependent upon the voltage pattern on said array to form a printable image.

7. The method of claim 6, wherein said printing medium is collected on said array of discrete elements to form a printable image on the face of said plate.

8. The method of claim 6, further comprising interposing a sheet of printing paper between the plate and the developer fluid and in contact with the surface of said plate whereby the printable images is deposited directly on said paper.

* * * * *